US010369065B2

(12) United States Patent
DuFresne et al.

(10) Patent No.: US 10,369,065 B2
(45) Date of Patent: Aug. 6, 2019

(54) BACK SUPPORT ATTACHMENT AND ADJUSTMENT ASSEMBLY FOR A WHEELCHAIR

(71) Applicant: The Comfort Companies, LLC, Bozeman, MT (US)

(72) Inventors: Steven DuFresne, Hartland, WI (US); Anthony Berg, New Berlin, WI (US)

(73) Assignee: THE COMFORT COMPANIES, LLC, Bozeman, MT (US)

( * ) Notice: Subject to any disclaimer, the term of this patent is extended or adjusted under 35 U.S.C. 154(b) by 14 days.

(21) Appl. No.: 15/448,243

(22) Filed: Mar. 2, 2017

(65) Prior Publication Data

US 2017/0252240 A1 Sep. 7, 2017

Related U.S. Application Data

(60) Provisional application No. 62/302,460, filed on Mar. 2, 2016.

(51) Int. Cl.
*A61G 5/10* (2006.01)

(52) U.S. Cl.
CPC ..... *A61G 5/1067* (2013.01)

(58) Field of Classification Search
CPC ..... A61G 5/1067; A61G 5/122; A61G 5/04
See application file for complete search history.

(56) References Cited

U.S. PATENT DOCUMENTS 4,749,230 A * 6/1988 Tornero ..... A47C 7/402 248/244
4,797,960 A * 1/1989 Vaiana ..... A61G 5/00 297/337
4,930,840 A * 6/1990 Tornero ..... A47C 7/402 297/353
5,593,211 A * 1/1997 Jay ..... A61G 5/10 297/354.12
5,597,204 A * 1/1997 Karaus, Jr. ..... A47C 7/402 297/353
5,649,741 A * 7/1997 Beggs ..... A47C 7/402 297/353
5,951,107 A * 9/1999 Tornero ..... A47C 7/402 297/353
6,139,037 A * 10/2000 Papac ..... A61G 5/00 280/250.1
6,264,276 B1 * 7/2001 Chen ..... A47C 7/402 297/353
6,840,577 B2 * 1/2005 Watkins ..... A61G 5/1064 297/284.9
8,070,232 B2 * 12/2011 Hung ..... A47C 7/405 280/304.1
8,517,469 B1 * 8/2013 Hetzel ..... A61G 5/1067 280/250.1
9,364,378 B2 * 6/2016 Mael ..... A61G 5/08
9,795,527 B2 * 10/2017 Stenstrom ..... A61G 5/12
9,943,456 B2 * 4/2018 Goeckel ..... A61G 5/1067
(Continued)

*Primary Examiner* — Philip F Gabler
(74) *Attorney, Agent, or Firm* — Michael Best & Friedrich LLP

(57) ABSTRACT

An attachment and adjustment assembly for a chair includes a mounting plate, a track assembly coupled to the mounting plate, and a back support coupled to the track assembly, wherein the track assembly facilitates sliding movement of the back support relative to the mounting plate.

20 Claims, 11 Drawing Sheets

(56) References Cited

U.S. PATENT DOCUMENTS

| | | | | |
|---|---|---|---|---|
| 2006/0076815 | A1* | 4/2006 | Cramer | A61G 5/12 297/358 |
| 2012/0091300 | A1* | 4/2012 | Bee | A61G 5/1067 248/219.4 |
| 2012/0266438 | A1* | 10/2012 | Nickerson | A61G 5/10 29/428 |
| 2017/0079862 | A1* | 3/2017 | Jurkiewicz | A61G 5/1062 |
| 2017/0135484 | A1* | 5/2017 | DuFresne | A47C 1/027 |

* cited by examiner

BACK SUPPORT ATTACHMENT AND ADJUSTMENT ASSEMBLY FOR A WHEELCHAIR

CROSS REFERENCE TO RELATED APPLICATIONS

This application claims priority to U.S. Provisional Patent Application No. 62/302,460, filed on Mar. 2, 2016 and entitled "Back Support Attachment and Adjustment Assembly for a Wheelchair," the contents of which is hereby incorporated by reference in its entirety.

FIELD OF THE DISCLOSURE

The present disclosure relates to an adjustable back support for a chair. More specifically, the present disclosure relates to an interface for attaching and adjusting a back support for a wheelchair, such as a powered wheelchair.

SUMMARY

In one embodiment, an attachment and adjustment assembly for a chair includes a mounting plate, a track assembly coupled to the mounting plate, and a back support coupled to the track assembly, wherein the track assembly facilitates sliding movement of the back support relative to the mounting plate.

In another embodiment, an attachment and adjustment assembly for a chair includes a mounting plate that defines a channel, a track coupled to the mounting plate, a first slide positioned in sliding engagement with the track, a mounting member coupled to the slide, and a back support coupled to the mounting member. The slide facilitates sliding movement of the back support relative to the mounting plate.

Other aspects of the invention will become apparent by consideration of the detailed description and accompanying drawings.

DETAILED DESCRIPTION

Figure 1:
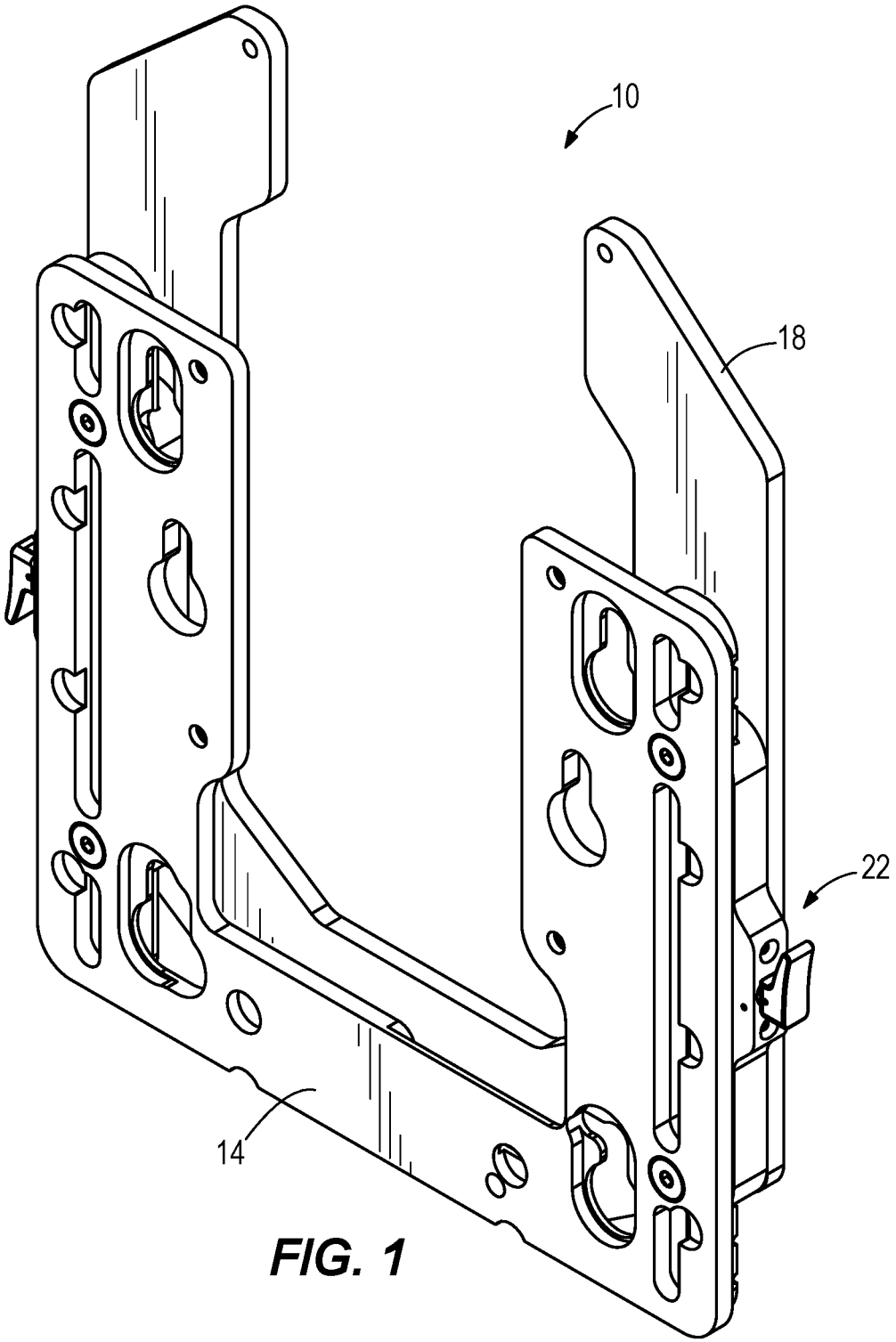
FIG. 1 is a perspective view of an embodiment of an attachment and adjustment assembly for selectively mounting and adjusting a position of a back support to a wheelchair, showing a wheelchair facing side.

Before embodiments of the disclosure are explained in detail, it is to be understood that the disclosure is not limited in its application to the details of construction and the arrangement of components set forth in the following description or illustrated in the accompanying drawings. The disclosure is capable of supporting other embodiments and of being practiced or of being carried out in various ways.

While the present disclosure refers to an attachment and adjustment assembly 10 (shown in FIG. 1) for selectively mounting and adjusting a position of a back support to a wheelchair, and more specifically a powered wheelchair, it should be appreciated that reference to a wheelchair and/or a powered wheelchair is provided for purposes of illustration, and should not be construed as limiting. The attachment and adjustment assembly 10 for a back support as described herein can be used not only with a wheelchair and/or a powered wheelchair, but also can be used in association with any suitable chair, including, but not limited to, an armchair, a rocking chair, a car seat, a swivel chair, an office chair, a recliner, a director's chair, a high chair, a sofa, a backed stool, or any other suitable device for supporting a person while sitting or standing, or otherwise using the suitable device to support a thoracic cavity.

A powered wheelchair is a type of wheelchair that is used to propel an individual who is unable to operate a manually powered wheelchair, or requires assistance with mobility (e.g., due to cardiovascular impairments, fatigue-based conditions, etc.). A powered wheelchair is generally a motorized wheelchair that is propelled by a motor instead of manual power. A powered wheelchair typically operates by an electric motor that is activated by a controller, for example an arm-rest mounted joystick or a sip-and-puff controller (for individuals who are unable to use a hand controller). A powered wheelchair is often synonymously referred to as a powerchair, an electric wheelchair, a tank chair (or other tracked chair), or an electric-powered wheelchair (or "EPW").

A powered wheelchair includes a seat (or a seat base) and a back (or a seat back). The seat back is generally a flat, hard surface that includes a mounting structure for mounting a back support to the seat back. This allows for installation, positioning, and use of different back supports that can address different needs of different users. As a non-limiting example, a user having a spinal abnormality such as a curvature (e.g., scoliosis, kyphosis, lordosis, etc.) will generally require a back support that is at minimum positioned on the seat back in an orientation that is different than the positioning of a back support for a user having a healthy spine. Rather than integrating a number of specialized back supports into a powered wheelchair seat back, manufacturers instead provide a mounting structure for a back support. This allows a therapist, other professional, or individual that fits a powered wheelchair to a user (collectively a "fitter"), to attach and position a back support to the powered wheelchair seat back that is suitable for the user.

However, different commercially available models of powered wheelchairs have different mounting structures for mounting a back support to the seat back. As one example, Pride Mobility Products Corp., which has a U.S. corporate headquarters in Exeter, Pa., sells a powered wheelchair where the seat back has a first mounting structure that includes two spaced apart, vertical rows of threaded apertures. A plurality of threaded fasteners (e.g., threaded pins, mounting bolts, etc.) engage the seat back, with one fastener being threaded into a corresponding aperture. While the fasteners can be moved to different apertures, the vertical rows of apertures are not adjustable and remain the same distance (or width) apart.

In contrast, Sunrise Medical LLC, which has a U.S. corporate headquarters in Fresno, Calif., sells a powered wheelchair where the seat back has a different mounting structure. More specifically, the seat back has a second mounting structure that includes two spaced apart, horizontal rows of threaded apertures. A plurality of threaded fasteners (e.g., threaded pins, mounting bolts, etc.) engage the seat back, with one fastener being threaded into a corresponding aperture. While the fasteners can be moved to different apertures, the horizontal rows of apertures are not adjustable and remain the same distance (or height) apart. The second mounting structure on the seat back of the Sunrise Medical LLC powered wheelchair has different dimensions than the first mounting structure on the seat back of the Pride Mobility Products Corp. powered wheelchair.

Further, Permobil Inc., which has a U.S. corporate headquarters in Lebanon, Tenn., sells a powered wheelchair where the seat back has yet another, different mounting structure. More specifically, the seat back has a third mounting structure that includes two spaced apart, vertical rows of threaded apertures. A plurality of threaded fasteners (e.g., threaded pins, mounting bolts, etc.) engage the seat back, with one fastener being threaded into a corresponding aperture. While the fasteners can be moved to different apertures, the vertical rows of apertures are not adjustable and remain the same distance (or width) apart. The third mounting structure on the seat back of the Permobil Inc. powered wheelchair has a different width between the vertical rows of threaded apertures than the width between the vertical rows of threaded apertures of the first mounting structure on the Pride Mobility Products Corp. powered wheelchair seat back. The third mounting structure on the seat back of the Permobil Inc. powered wheelchair also has different dimensions than the second mounting structure on the seat back of the Sunrise Medical LLC powered wheelchair. Since there is no standardized mounting structure or standardized mounting structure dimensions for mounting a back support to a powered wheelchair seat back, a single back support cannot be properly mounted to the seat backs of powered wheelchairs sold by different or multiple sellers without additional customization. Accordingly, there is a need to provide an apparatus to facilitate mounting of a back support to the seat backs of multiple powered wheelchairs, and more specifically powered wheelchairs that are commercially available from different companies.

Commercially available mounting structures for mounting a back support to a seat back of a powered wheelchair also have certain limitations relating to adjustment and/or proper fitting of a back support to the user of the powered wheelchair. For example, with these commercially available mounting structures, such as those referred to above, the back support is directly mounted to the seat back by a fastener (e.g., threaded bolt, etc.). While providing a secure attachment of the back support to the seat back, it leads to difficulty during proper fitting of the user to the powered wheelchair. During fitting, the back support is mounted to the seat back, and then the user is positioned into the powered wheelchair. However, many times the back support has to be repositioned relative to the seat back to achieve a proper fit for the user. In this situation, the user has to be removed from the powered wheelchair, the back support has to be removed from the seat back, repositioned, and remounted to the seat back, and then the user is repositioned into the powered wheelchair to determine if the fit is correct. In certain circumstances, this process has to be repeated several times. For a user that has limited use (or no use) of extremities (e.g., legs, arms, etc.), removal from the powered wheelchair can be onerous and/or time consuming for the fitter, as the user may have to be removed with a harness and associated lift assembly, or by one or more people. Accordingly, there is a need to provide an apparatus that allows for adjustment or repositioning of the back support relative to the seat back while the user remains in the powered wheelchair (or without having to remove the user from the powered wheelchair).

Figure 2:
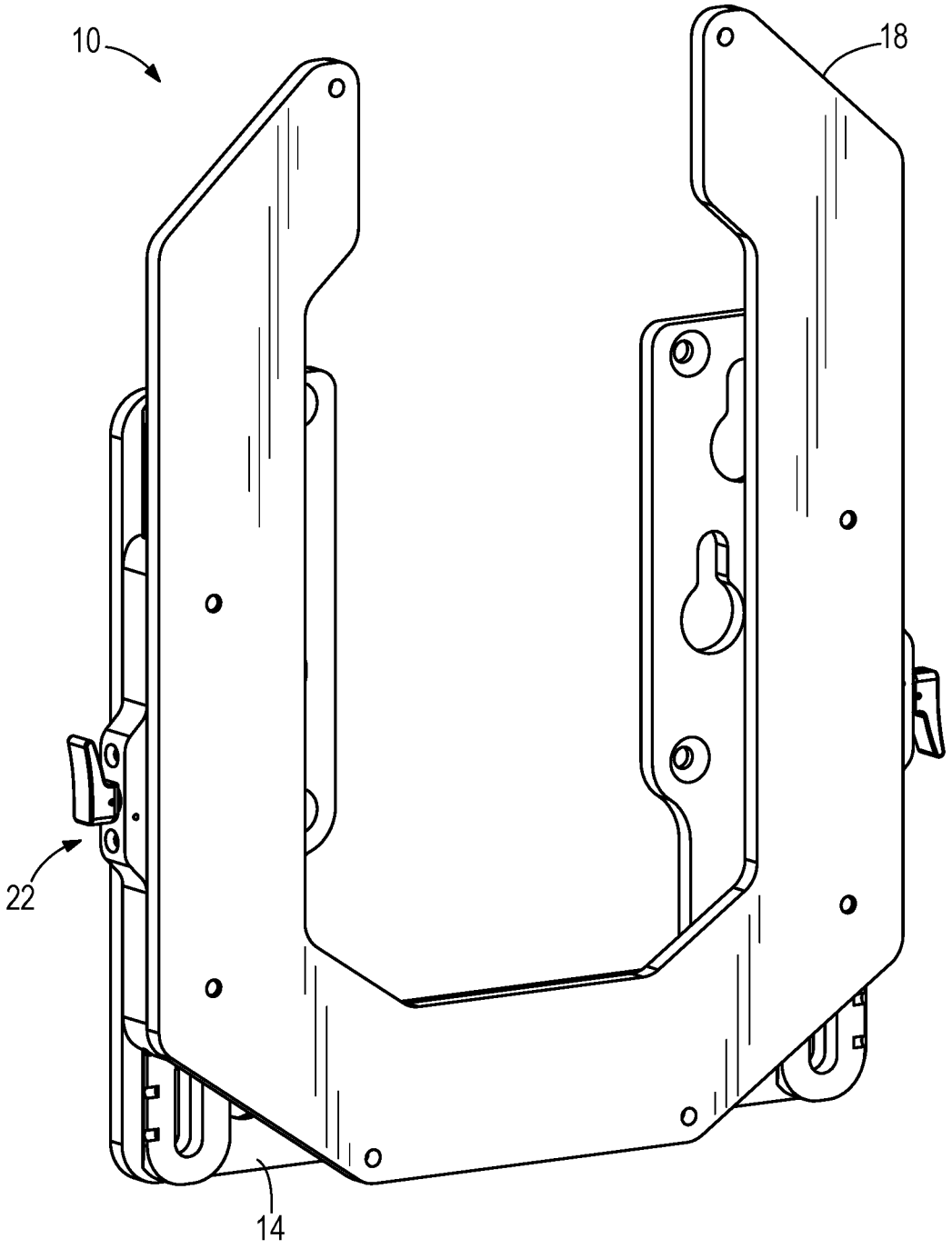
FIG. 2 is a perspective view of the attachment and adjustment assembly of FIG. 1, showing a back support facing side.

With reference now to FIGS. 1-2, a perspective view of an embodiment of an attachment and adjustment assembly 10 for selectively mounting and adjusting a position of a back support to a seat back of a motorized wheelchair. The attachment and adjustment assembly 10 includes a mounting plate 14, a mounting member 18, and a track assembly 22. The mounting plate 14 is configured to couple (or mount or attach) to the seat back of a motorized wheelchair. The mounting member 18 is configured to couple (or mount or attach) to a back support. The track assembly 22 is configured to couple (or otherwise selectively attach) the mounting member 18 to the mounting plate 14. In addition, the track assembly 22 is configured to facilitate repositioning of the mounting member 18 relative to the mounting plate 14.

Figure 3:
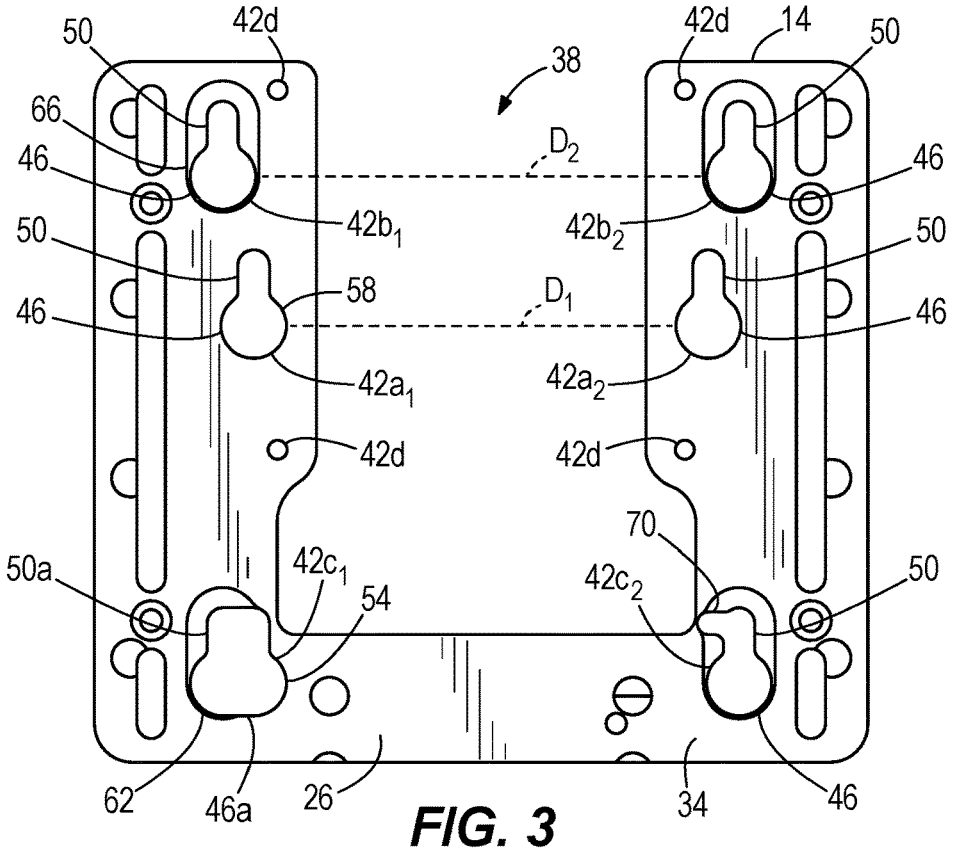
FIG. 3 is an elevation view of a mounting plate of the attachment and adjustment assembly of FIG. 1, showing the wheelchair facing side and having all other components of the attachment and adjustment assembly removed.
Figure 4:
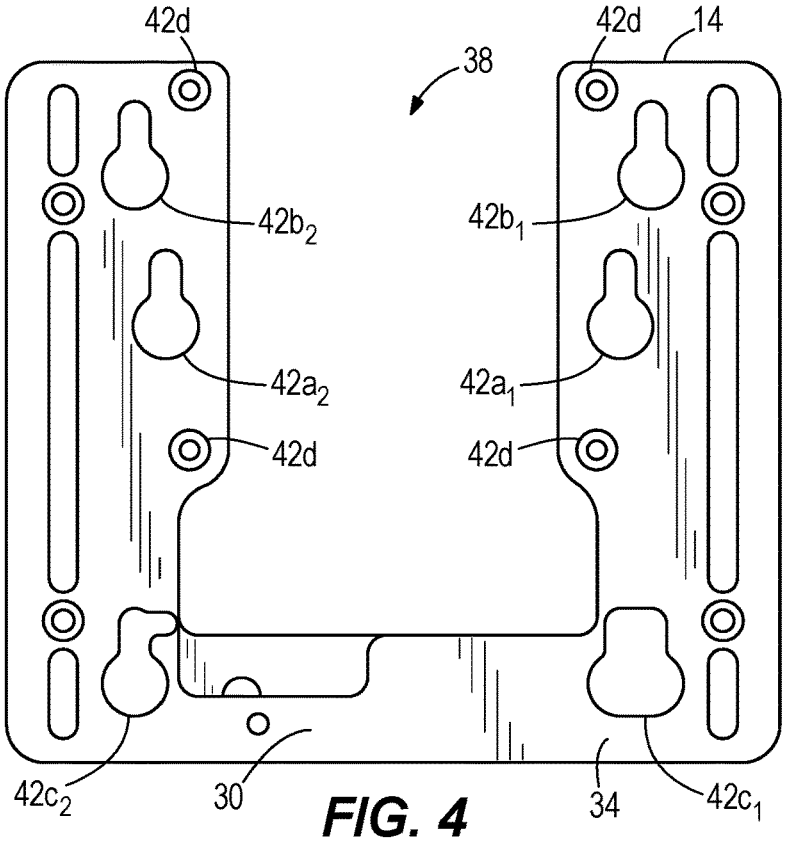
FIG. 4 is an elevation view of the mounting plate of FIG. 3, showing the back support facing side.

Referring now to FIGS. 3-4, the mounting plate 14 includes a first side 26 that is opposite a second side 30. The first side 26 (or seat back facing side 26), which is shown in FIG. 3, faces the seat back of the powered wheelchair, while the second side 30 (or back support facing side 30), which is shown in FIG. 4, faces the back support. The mounting plate 14 also includes a planar mounting body 34 that defines a channel 38 (or opening 38) that is generally centrally positioned to form a general U-shape. The channel 38 facilitates a connection of a back support to a seat back that includes one or more additional components (not shown) that would otherwise block such a connection. As a non-limiting example, the seat back can include a drive component for the wheelchair, a head support, or another additional component that can assist with operation of the powered wheelchair or proper positioning of the user in the powered wheelchair. One or more of these additional components can interfere with attachment of the mounting plate 14 to the seat back without the channel 38. In embodiments of the seat back that include one or more additional components, the component(s) are received by (or positioned within) the channel 38, with the mounting plate 14 extending around a portion of the component(s). It should be appreciated that in other embodiments of the mounting plate 14, the channel 38 can be optional. Embodiments without the channel 38 can be used when there are no additional components as referenced above. Further, while the illustrated embodiment of the mounting plate 14 illustrates the channel 38 as generally centrally positioned, in other embodiments, the channel 38 can be positioned at any suitable location on the mounting plate 14 to facilitate a connection of the back support to the seat back while also receiving or otherwise accounting for one or more additional components that could otherwise interfere with mounting of the back support to the seat back. In addition, while the illustrated embodiment of the mounting plate 14 includes one channel 38 (or opening 38), in other embodiments the mounting plate 14 can include a plurality of separate channels 38 (or openings 38). In addition, other embodiments of the mounting plate 14 can form any suitable shape, such as a C-shape, an upside down U-shape, a rectangle, a square, or any other suitable shape to facilitate mounting of a back support to a seat back of a powered wheelchair.

The mounting plate 14 acts as an interface between the seat back of the powered wheelchair and the back support. The mounting plate 14 (or interface mounting plate 14) is configured to attach to a plurality of different powered wheelchair seat backs. Stated another way, the mounting plate 14 is a "universal" mounting plate configured to engage different commercially available mounting structures to mount a back support to two or more different commercially available seat backs of a powered wheelchair. With continued reference to FIGS. 3-4, the mounting plate 14 includes a plurality of mounting points 42 that are configured to engage different mounting structures. More specifically, the mounting plate 14 includes a plurality of first mounting apertures 42*a* a plurality of second mounting apertures 42*b*, a plurality of third mounting apertures 42 *c*, and a plurality of fourth mounting apertures 42*d*. The plurality of mounting apertures 42 are configured to receive fasteners of a different seat back mounting structures, allowing the mounting plate 14 to attach, mount, or otherwise couple to different mounting structures of different seat backs.

The first mounting apertures 42*a* include a first portion 46 and a second portion 50. The first portion 46 includes a diameter that is sufficient to receive a fastener of a mounting structure. The second portion 50 defines a slot (or a first slot) that has a diameter that is less than the diameter of the first portion 46. As such, a head of a fastener (e.g., a bolt head, etc.) can be received by the first portion 46. Once received, the mounting plate 14 can slide, shifting the head of the fastener from the first portion 46 to the second portion 50, coupling the mounting plate 14 to the seat back. First mounting apertures 42$a_1$, 42$a_2$ are substantially the same, are positioned on opposing sides of the channel 38, and are separated by a first distance $D_1$.

The second mounting apertures 42*b* are substantially the same as the first mounting apertures 42*a*, with like numbers describing like components. Second mounting apertures 42$b_1$, 42$b_2$ are substantially the same, are positioned on opposing sides of the channel 38, and are separated by a second distance $D_2$. The second distance $D_2$ is greater than the first distance $D_1$ meaning the second mounting apertures 42*b* are spaced further apart than the first mounting apertures 42*a*. Stated another way, the first and second mounting apertures of each side (e.g., 42$a_1$, 42$b_1$ and 42$a_2$, 42$b_2$) are not vertically aligned, or otherwise are offset in a horizontal direction (or are horizontally offset).

The third mounting apertures 42*c* include a first portion 46 and a second portion 50 that is substantially the same as those in the first and second mounting apertures 42*a*, 42*b*. Third mounting apertures 42$c_1$, 42$c_2$ are positioned on opposing sides of the channel 38, and are each sized (or have a geometry) such that a portion is aligned with the first mounting aperture 42$a_1$ or 42$a_2$, and a portion is aligned with the second mounting aperture 42$b_1$ or 42$b_2$. More specifically, third mounting aperture 42$c_1$ includes a first portion 46*a* that has a diameter that is greater than the first portions 46 of the first and second mounting apertures 42$a_1$, 42$b_1$, and a second portion 50*a* that has a diameter that is greater than the second portions 50 of the first and second mounting apertures 42$a_1$, 42$b_1$. This allows a first edge 54 of the third mounting aperture 42$c_1$ to be vertically aligned with a corresponding edge 58 (or portion) of the first mounting aperture 42$a_1$, and an opposing second edge 62 of the third mounting aperture 42$c_1$ to be vertically aligned with a corresponding edge 66 (or portion) of the second mounting aperture 42$b_1$. This allows the third mounting aperture 42$c_1$ to cooperate with the first or second mounting apertures 42$a_1$, 42$b_1$ to mount the mounting plate 14 to different seat backs. The third mounting aperture 42$c_2$ includes a third portion 70 (or a second slot 70) that intersects the second portion 50 (or the first slot 50), and further is approximately perpendicular (or orthogonal) to the second portion 50. This allows the second portion 50 to be vertically aligned with a portion of the second mounting aperture 42$b_2$, and more specifically the second portion 50 of the second mounting aperture 42$b_2$. In addition, a portion of the third portion 70 is vertically aligned with a portion of the first mounting aperture 42$a_2$, and more specifically the second portion 50 of the first mounting aperture 42$a_2$. This allows the third mounting aperture 42$c_2$ to cooperate with the first or second mounting apertures 42$a_2$, 42$b_2$ to mount the mounting plate 14 to different seat backs. It should be appreciated that in other embodiments, the third mounting apertures 42*c* can both have the geometry of mounting aperture 42$c_1$ or 42$c_2$.

The fourth mounting apertures 42*d* are illustrated as apertures defined by the mounting plate 14 at different positions. In operation, the mounting apertures 42*a*, 42*b*, 42*c*, 42*d* can couple to different mounting structures of different commercially available powered wheelchairs, facilitating a universal mount for a back support that connects to most commercially available seat backs. For example, the first and third mounting apertures 42*a*, 42*c* cooperate to respectively receive fasteners of a first mounting structure (e.g., the mounting structure commercially used by Pride Mobility Products Corp.). The fourth mounting apertures 42*d* respectively receive fasteners of a second mounting structure (e.g., the mounting structure commercially used by Sunrise Medical LLC). In addition, the second and third mounting apertures 42*b*, 42*c* cooperate to respectively receive fasteners of a third mounting structure (e.g., the mounting structure commercially used by Permobil Inc.). It should be appreciated that in other embodiments of the mounting plate 14, fewer or additional mounting apertures 42 can be incorporated. In addition, the positions of the mounting apertures 42 illustrated in FIGS. 3-4 are provided for purposes of illustration, and can be changed or altered within the scope of the innovation disclosed herein.

As referred to above, the attachment and adjustment assembly 10 includes the track assembly 22 that adjustably couples a back support to the mounting plate 14. The track assembly 22 includes at least one rail 74, and at least one slide 78 that is slidably associated with the at least one rail 74. In the embodiment illustrated in the figures, the track assembly 22 includes a pair of rails 74*a*, 74*b*, and a pair of associated slides 78*a*, 78*b*. However, in other embodiments, the track assembly 22 can include one, two, or three or more rails 74, each rail 74 having at least one slide 78.

Figure 5:
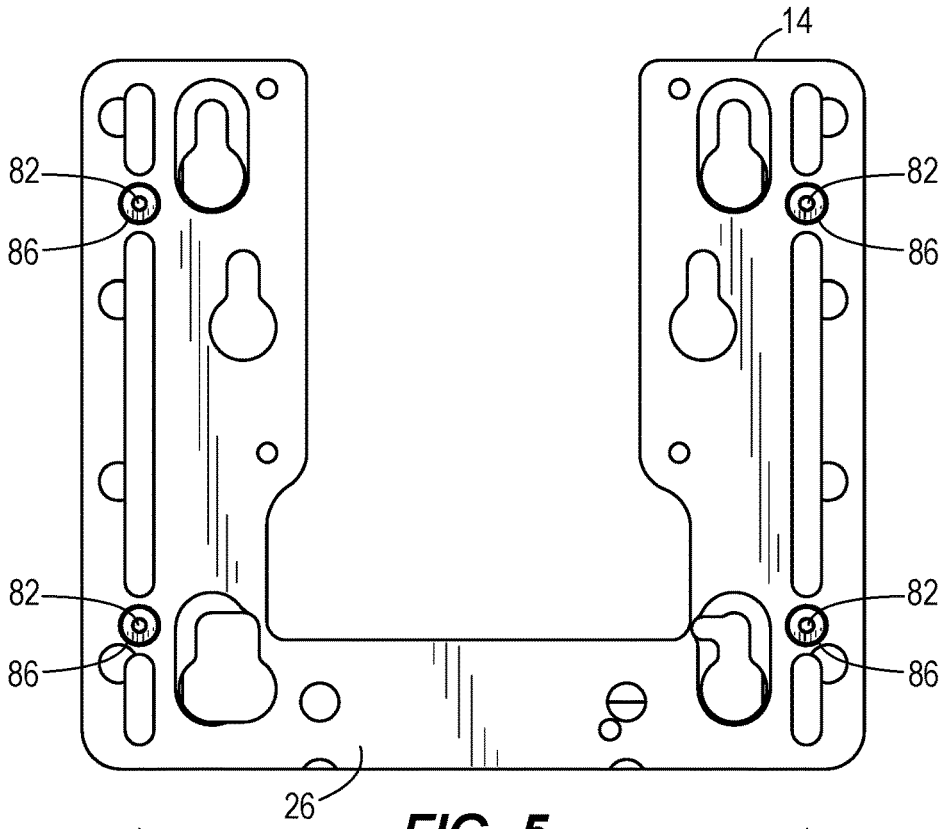
FIG. 5 is an elevation view of the mounting plate of FIG. 3, showing the wheelchair facing side and having a pair of rails coupled to the back support facing side.
Figure 6:
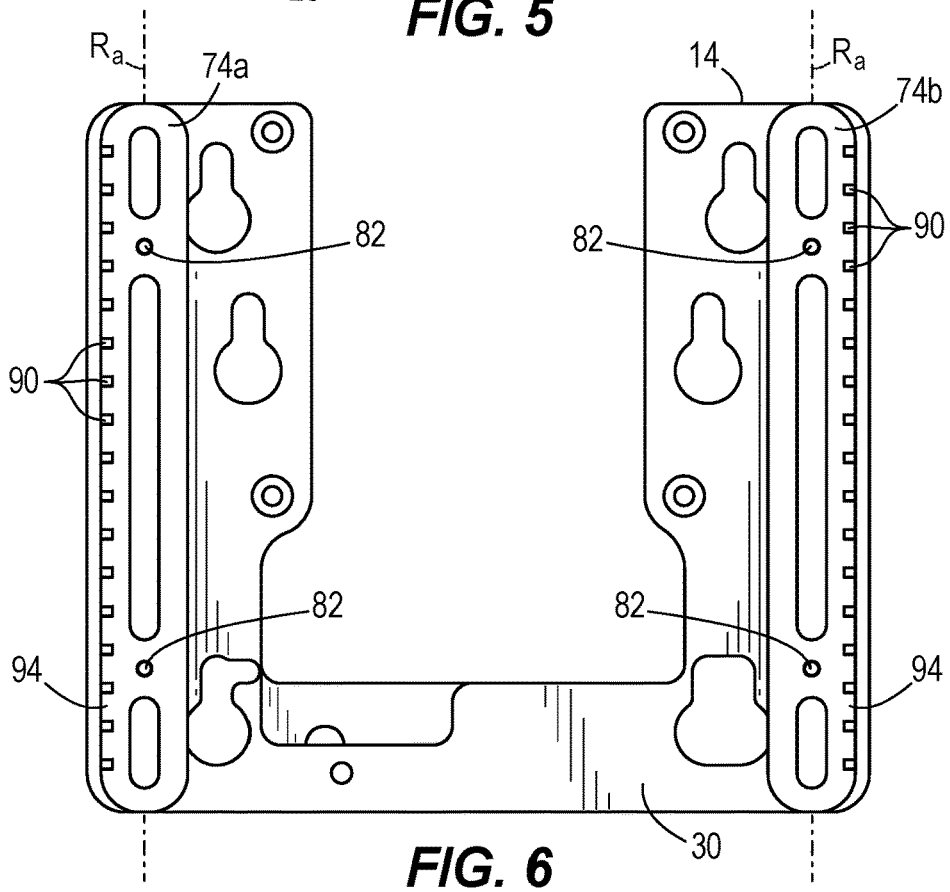
FIG. 6 is an elevation view of the mounting plate of FIG. 5, showing the rails coupled to the back support facing side.

Referring now to FIGS. 5-6, the rails 74*a*, 74*b* (shown in FIG. 6) can be removably attached to the mounting plate 14 by a fastener 82 (e.g., a bolt, etc.). Each fastener 82 is received by an aperture 86 (shown in FIG. 5) that extends through and is defined by the mounting plate 14. This allows for selective repositioning of the rails 74*a*, 74*b* (shown in FIG. 6) relative to the mounting plate 34 when mounting to a seat back (for example, the rails 74*a*, 74*b* can be removed, the mounting plate 14 can be rotated and/or flipped to a different orientation, such as having the illustrated second side 30 face the seat back, and then the rails 74*a*, 74*b* can be reattached to the mounting plate 14). The rails 74*a*, 74*b* are spaced apart and positioned approximately parallel to each other. Each rail 74*a*, 74*b* defines a respective rail axis Ra, with each rail axis Ra also being spaced apart and approximately parallel to each other. Each rail 74*a*, 74*b* defines a plurality of grooves 90 (or notches 90 or recesses 90). The grooves 90 are spaced apart along an exposed edge 94 (or an outer edge 94) of each rail 74*a*, 74*b*. In the illustrated embodiment, the exposed edge 94 of each rail 74*a*, 74*b* is arranged parallel to the rail axis Ra.

Figure 7:
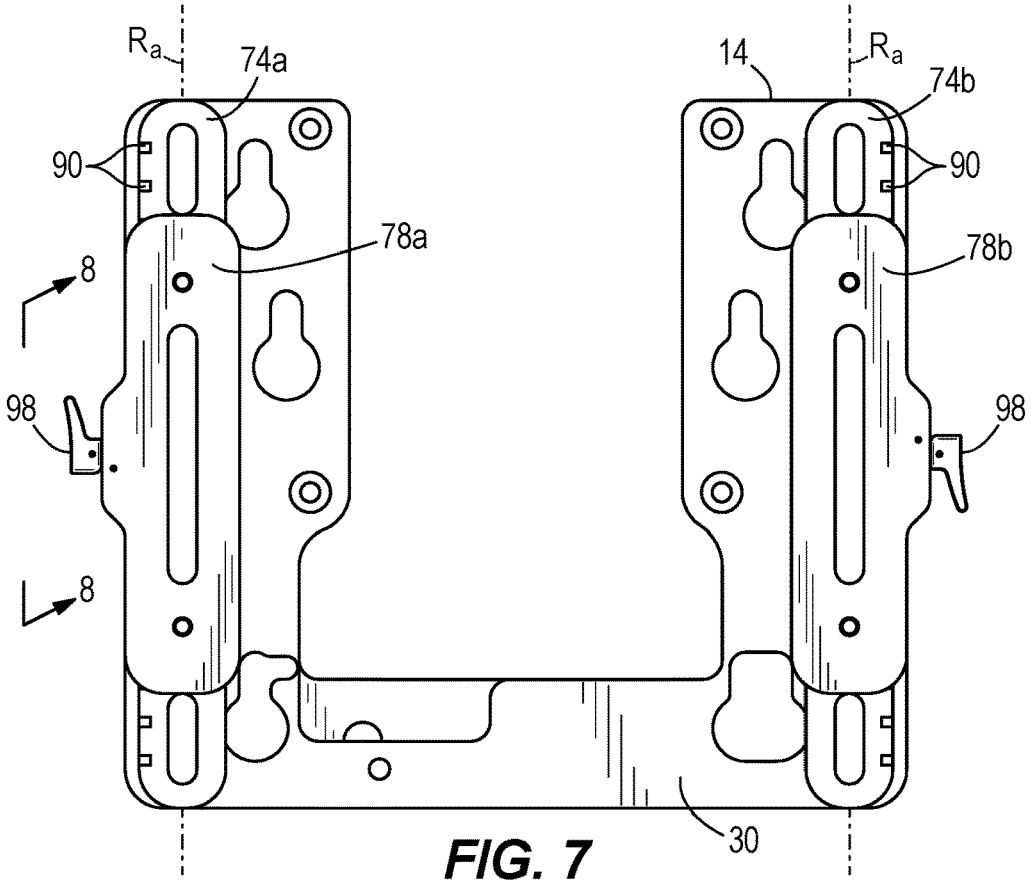
FIG. 7 is an elevation view of the mounting plate of FIG. 6, showing a slide coupled to each rail on the back support facing side.
Figure 8:
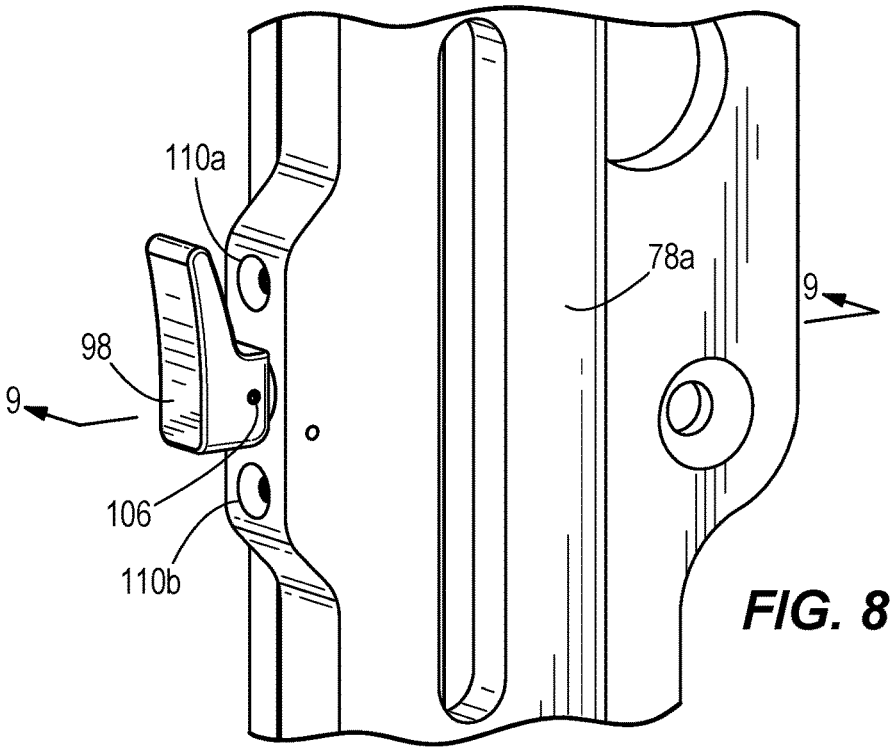
FIG. 8 is a perspective view of a slide and associated lever, taken along line 8-8 of FIG. 7.
Figure 9:
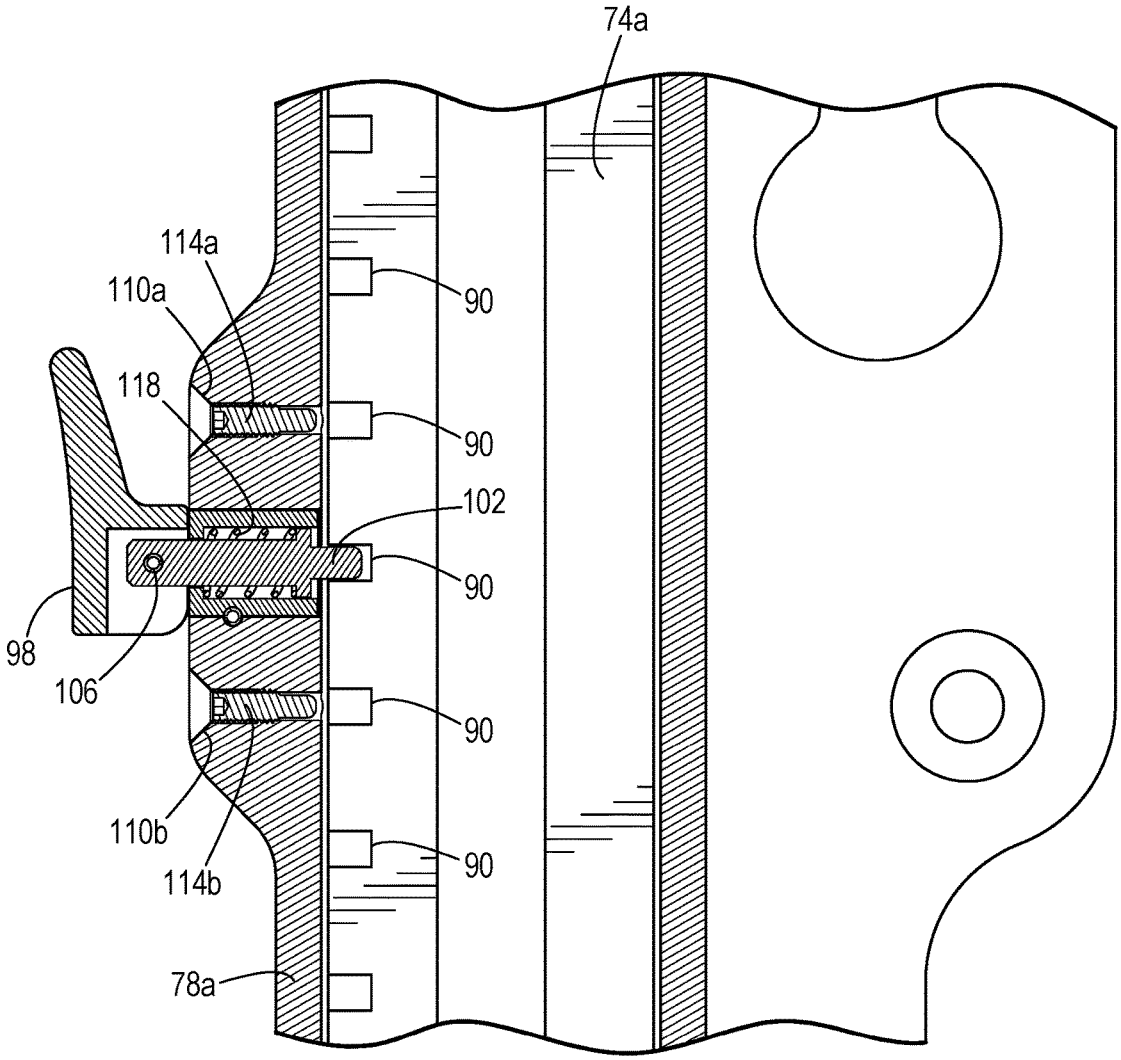
FIG. 9 is a cross-sectional view of the slide and rail, taken along line 9-9 of FIG. 8, and illustrating the fasteners as partially inserted into respective grooves.

FIG. 7 illustrates the slides 78*a*, 78*b* engaged with the respective rails 74*a*, 74*b*. Each slide 78*a*, 78*b* selectively slides relative to the respective rail 74*a*, 74*b* along the rail axis Ra. Stated another way, the slide 78*a* slides along the rail 74*a*, while the slide 78*b* slides along the rail 74*b*. To assist with retaining the slide 78*a*, 78*b* in a desired position relative to the respective rail 74*a*, 74*b*, each slide 78*a*, 78*b* includes a lever 98 that selectively actuates a pin 102 (shown in FIG. 9) into and out of engagement with one of the plurality of grooves 90 positioned on the rails 74*a*, 74*b*. As shown in FIG. 8, the lever 98 is pivotally connected to the slide 78*a* (or the first slide 78*a*), and configured to pivot with respect to a pivot pin 106 that defines a lever pivot axis. The slide 78*a* includes at least one aperture 110 that is configured to receive a fastener 114 (e.g., a set screw, etc.). In the embodiment shown in the figures, the slide 78*a* includes two apertures 110*a*, 110*b* that are positioned on opposing sides of the lever 98. The apertures 110*a*, 110*b* are positioned relative to the lever 98 such that three consecutive grooves 90 can be engaged by the pin 102 and fasteners 114. As illustrated in FIG. 9, the pin 102 selectively engages with (or is selectively received by) one of the plurality of grooves 90 of the rail 74*a* (or first rail 74*a*). A biasing member 118 (e.g., spring, etc.) biases the pin 102 into engagement with one of the grooves 90. A first fastener 114*a* is received by the first aperture 110*a*. The first fastener 114*a* can be a threaded member that can engage corresponding threads in the first aperture 110*a*. The first fastener 114*a* can be threaded into engagement with the first aperture 110*a* until the first fastener 114*a* is received by one of the plurality of grooves 90. Similarly, a second fastener 114*b* is received by the second aperture 110*b*. The second fastener 114*b* can be a threaded member that can engage corresponding threads in the second aperture 110*b*. The second fastener 114*b* can be threaded into engagement with the second aperture 110*a* until the second fastener 114*b* is received by one of the plurality of grooves 90. The fasteners 114*a*, 114*b* assist with maintaining the position of the slide 78*a* with respect to the rail 74*a* in a situation where the lever 98 is actuated unintendedly, disengaging the pin 102 from the selected groove 90. As such, the fasteners 114*a*, 114*b* assist the pin 102 with maintaining the desired position of the slide 78*a* with respect to the rail 74*b*. While the illustrated embodiment depicts two fasteners 114*a*, 114*b*, shown as set screws, positioned on opposite sides of the pin 102, and more specifically configured to engage the grooves 90 immediately next to the groove 90 that selectively receives the pin 102, in other embodiments the fasteners 114 can be spaced further away from the pin 102 (i.e., not configured to engage the grooves 90 immediately next to the groove that receives the pin 102). In yet other embodiments, only one fastener 114 can be used. For example, the fastener can be positioned either above or below the pin 102 and be configured to engage a groove 90. In yet other embodiments, the fastener 114 can be received by the lever 98, such that the fastener 114 can restrict actuation of the lever 98 with respect to the lever pivot 106 and/or restrict withdrawal of the pin 102 from the selected groove 90. In addition, more than two fasteners 114 can be used to assist with retaining the slide 78*a* in the desired position with respect to the rail 74*a*.

While the disclosure above and FIGS. 7-8 refer to and illustrate the first slide 78*a* in association with the first rail 74*a*, it should be appreciated that the slide 78*b* (or the second slide 78*b*) is substantially the same as the first slide 78*a*, and the rail 74*b* (or second rail 74*b*) is substantially the same as the first rail 74*a*. As such, the components and functionality described above in association with the first rail 74*a* and the first slide 78*a* apply to the second rail 74*b* and the second slide 78*b*, respectively.

It should be appreciated that together the pin 102 in each slide 78 and the grooves 90 on each rail define a detent structure between the each slide 78*a*, 78*b* and the respective rail 74*a*, 74*b*. This provides selective adjustment of the position of the slide 78*a*, 78*b* along each rail 74*a*, 74*b*. In the illustrated embodiment, the spacing of the grooves 90 provides eight inches of total sliding adjustability along each rail 74*a*, 74*b* in one-half inch increments. In other embodiments, the grooves 90 can be spaced to provide any suitable or desired total length of sliding adjustability (e.g., less than six inches, six inches, seven inches, nine inches, ten inches, more than ten inches, etc.) and/or increments of adjustability within the total length (e.g., less than one-quarter inch increments, one-quarter inch increments, one-third inch increments, one-inch increments, more than one-inch increments, etc.).

Figure 10:
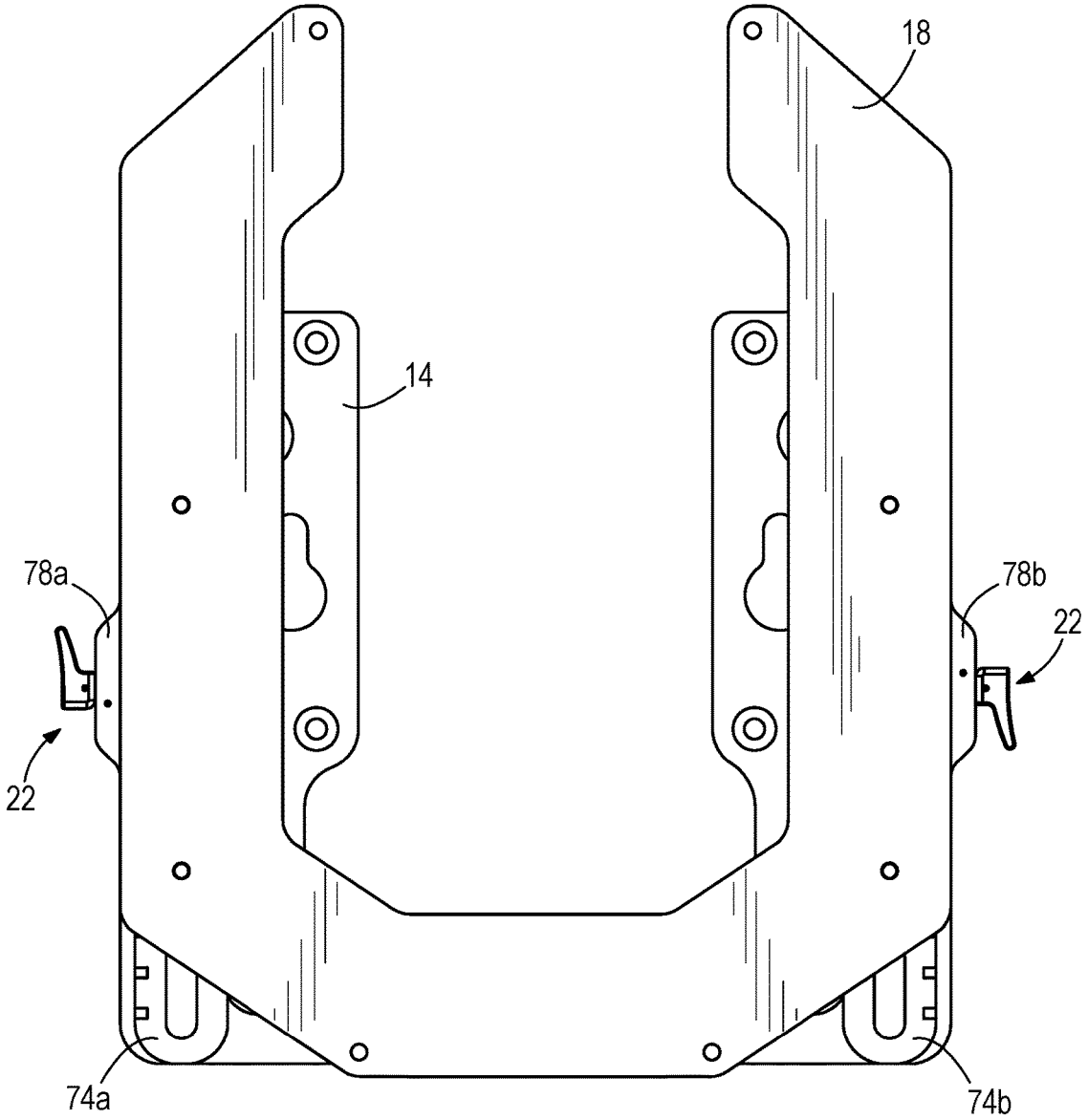
FIG. 10 is an elevation view of the mounting plate of FIG. 7, showing a mounting member coupled to the slides on the back support facing side.
Figure 11:
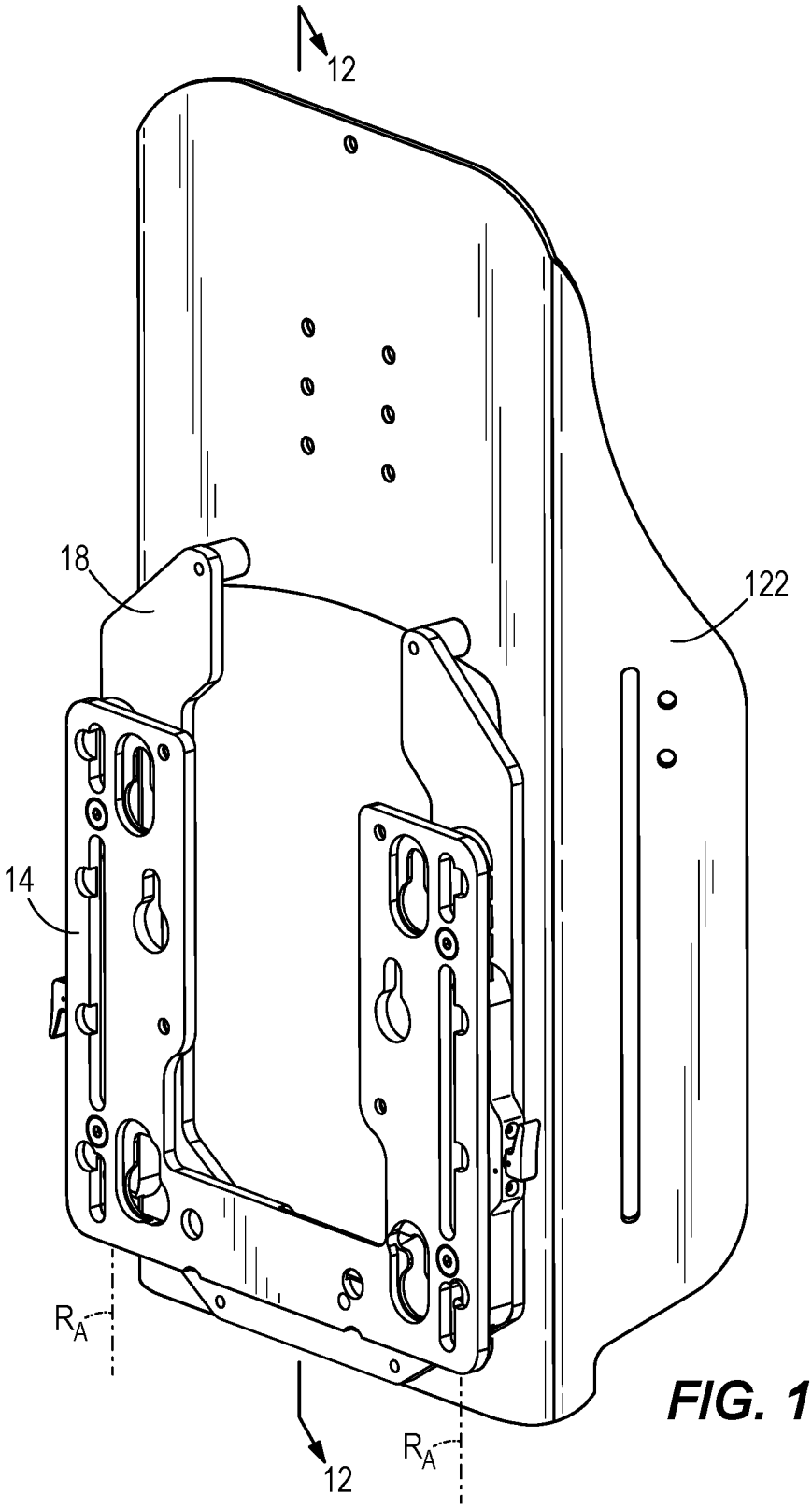
FIG. 11 is a perspective view of a back support coupled to the attachment and adjustment assembly of FIG. 1 viewed from the wheelchair facing side.
Figure 12:
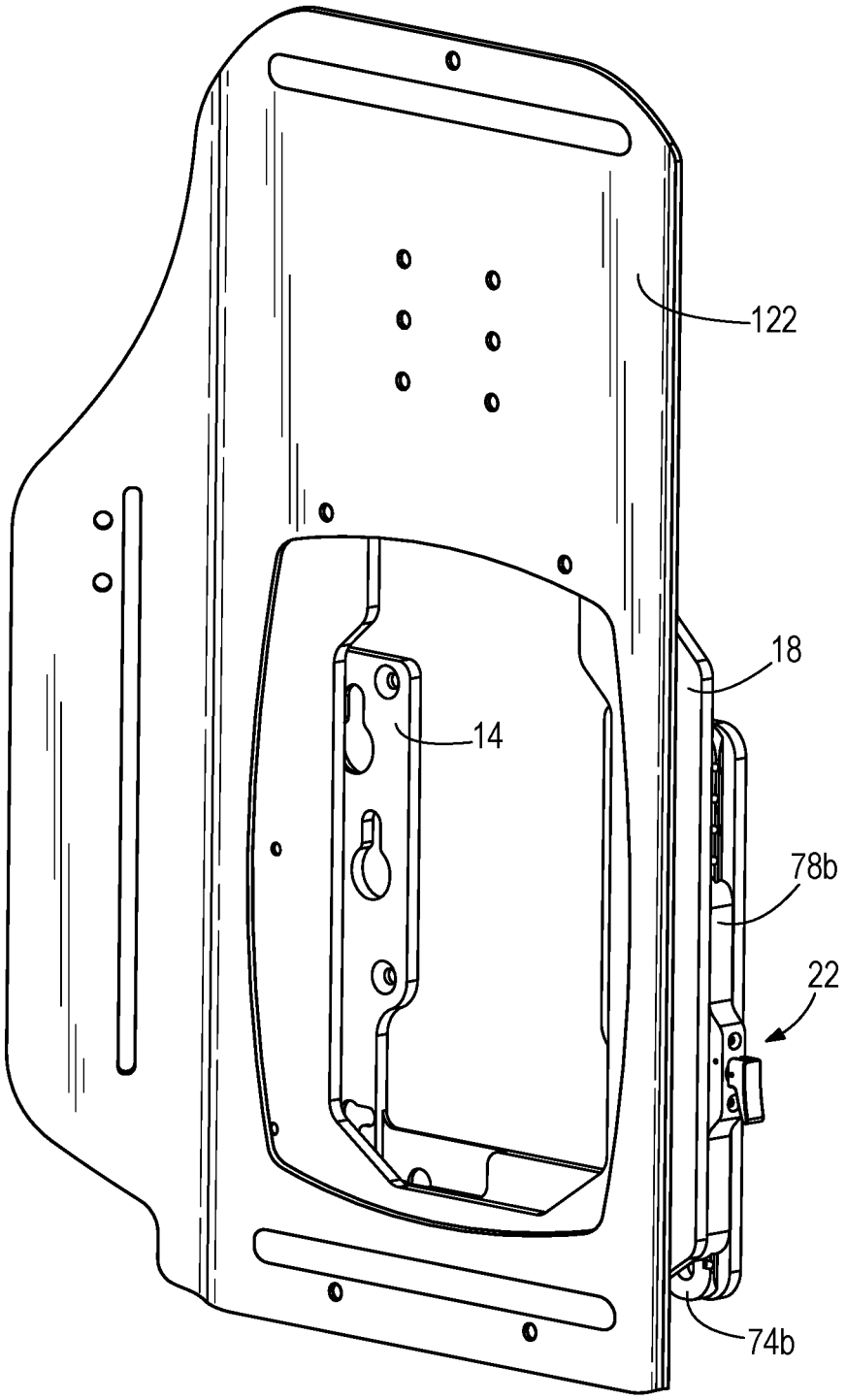
FIG. 12 is a perspective view of the back support coupled to the attachment and adjustment assembly of FIG. 11 viewed from the back support facing side.
Figure 13:
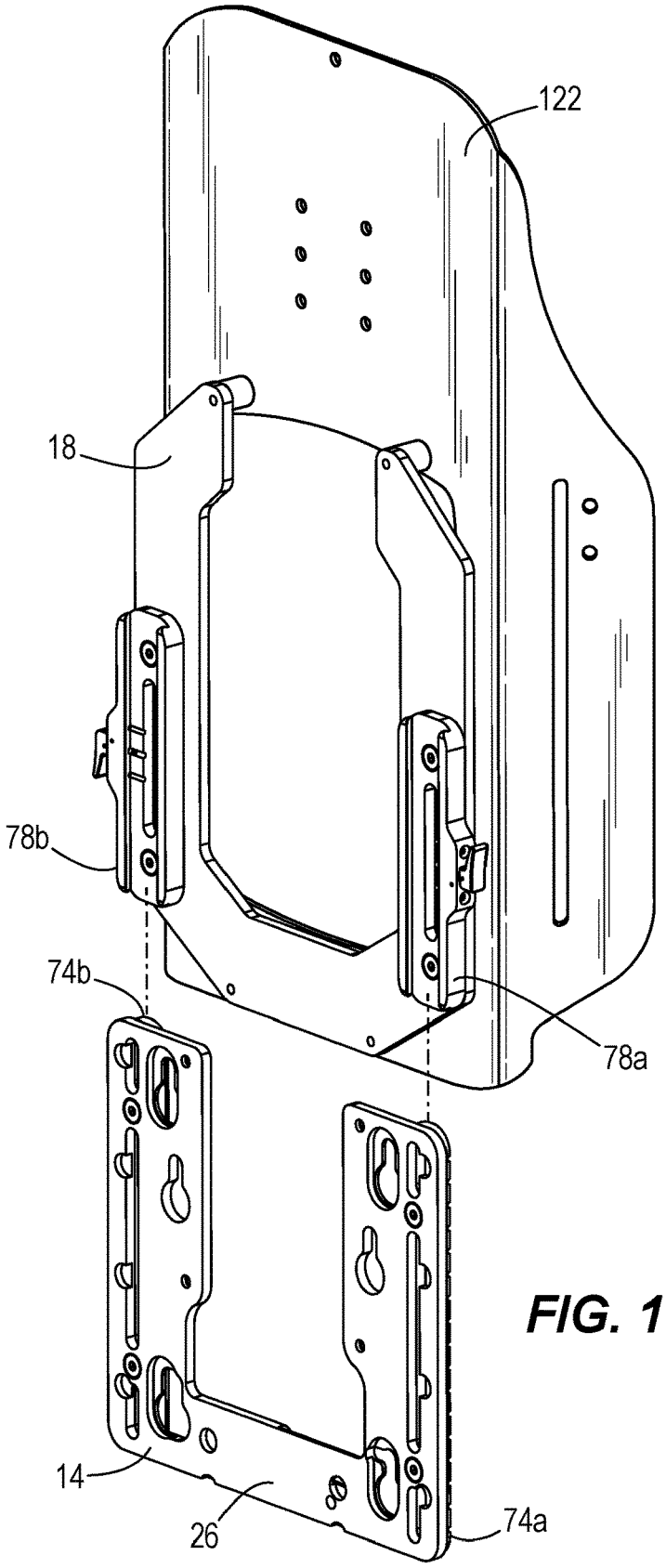
FIG. 13 is a perspective view of the back support slidably disengaged from the mounting plate viewed from the wheelchair facing side.

With reference now to FIG. 10, the track assembly 22 is coupled to the mounting member 18. The mounting member 18 is an intermediate member that couples the back support to the track assembly 22, and in turn the back support to the mounting plate 14. The illustrated mounting member 18 has a shape similar to the mounting plate 14 (i.e., a U-shape). However, in other embodiments the mounting member 18 can be any suitable shape. In addition, the mounting member 18 can be optional, with the track assembly 22 directly coupling to the back support (e.g., the slides 78 can couple to the back support, etc.). The mounting member 18 can also act as a spacer that provides spacing between the back support and the mounting plate 14.

Figure 14:
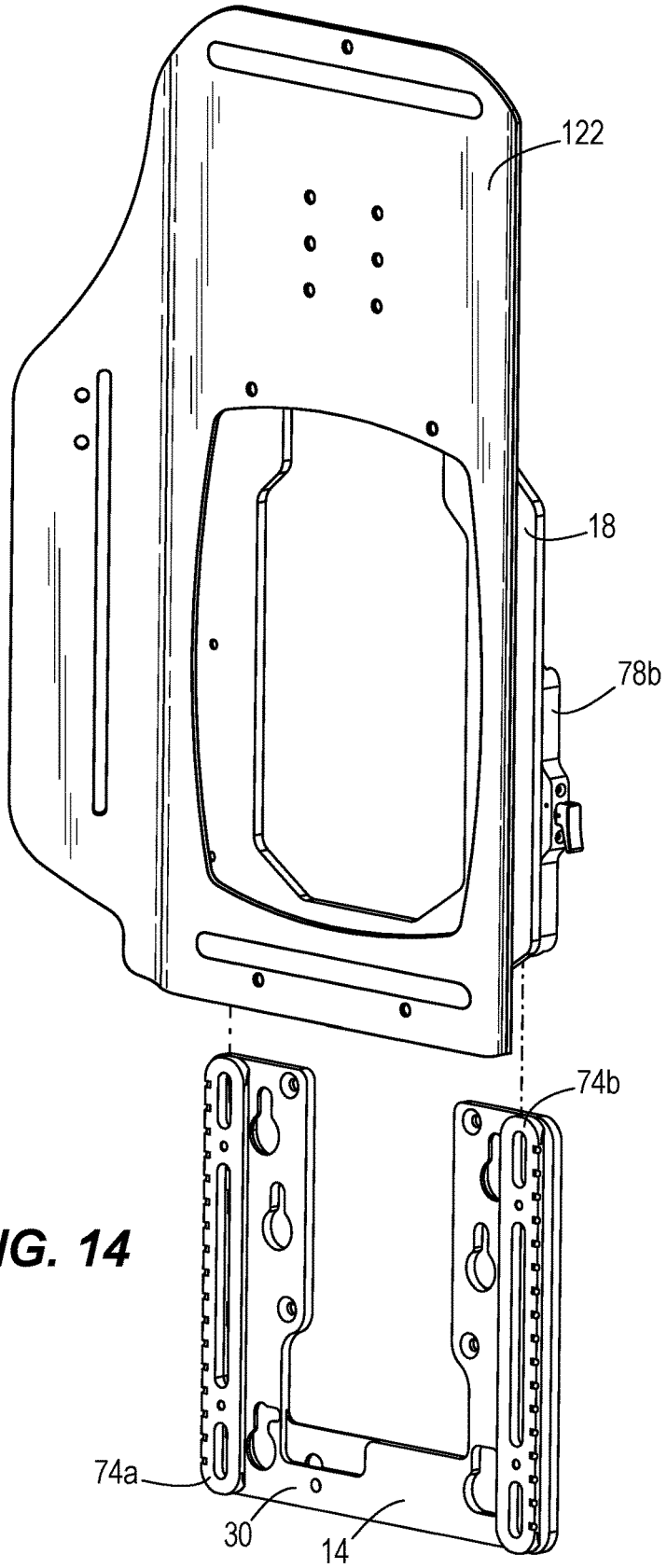
FIG. 14 is a perspective view of the back support slidably disengaged from the mounting plate viewed from the back support facing side.

FIGS. 11-14 illustrate the attachment and adjustment assembly 10 coupled to a back support 122. The back support 122 is illustrated as an ACTA-BACK brand back support sold by the Comfort Company of New Berlin, Wis. However, in other embodiments, the back support 122 can be any suitable back support that can be used to support a person using the powered wheelchair. The back support 122 is coupled to the mounting member 18 by a plurality of suitable fasteners (e.g., bolts, etc.) (not shown). The mounting member 18 is in turn slidably coupled to the track assembly 22, and more specifically to the slides 78*a*, 78*b* (see FIG. 13). Each slide 78*a*, 78*b* slidably engages the corresponding rail 74*a*, 74*b* (see FIG. 14), and the rails 74*a*,

74*b* are coupled to the mounting plate 14 (see FIG. 14). Each slide 78*a*, 78*b* is also configured to slidably disengage the respective rail 74*a*, 74*b* (see FIGS. 13-14). This allows the back support 122 to be slidably released from the mounting plate 14.

It should be appreciated that in other embodiments, the attachment and adjustment assembly 10 can include additional configurations. For example, the rails 74 can be coupled to the mounting member 18 or directly to the back support 122, while the slides 78 can be coupled to the mounting plate 14. In embodiments of the attachment and adjustment assembly 10 without the mounting member 18, the back support 122 can be coupled to the track assembly 22 (e.g., one of the slides 78 or the rails 74, etc.) to slidably couple the back support 122 to the mounting plate 14. As another example, the mounting plate 14 can directly mount to the mounting member 18 by one or more fasteners (e.g., bolt, etc.) (not shown), connecting the mounting plate 14 to the back support 122 (without rails 74 or slides 78). As yet another example, the mounting plate 14 can directly mount to the back support 122 (without rails 74, slides 78, or mounting member 18) by one or more fasteners (e.g., a bolt, etc.) (not shown). It should be appreciated that these examples are not limiting, and there may be one or more additional configurations to mount the back support 122 to the mounting plate 14.

In operation, once the back support 122 is mounted to the attachment and adjustment assembly 10, the assembly 10 can be mounted to the seat back of a powered wheelchair. More specifically, the mounting plate 14 can be coupled to the mounting structure of the seat back by one or more of the mounting apertures 42 (e.g., 42*a*, 42*b*, 42*c*, 42*d*). Once the back support 122 and the assembly 10 is mounted to the seat back, the back support 122 can be adjusted relative to the seat back, and more specifically relative to the mounting plate 14. With the fasteners 114 removed from each slide 78*a*, 78*b*, the lever 98 on each slide 78*a*, 78*b* is actuated to overcome the bias of the biasing member 118 and disengage (or withdraw) the pin 102 from the groove 90 in the respective rail 74*a*, 74*b*. The slides 78*a*, 78*b* are then free to slide relative to the respective rails 74*a*, 74*b*. As the slides 78*a*, 78*b* slide, the back support 122 slides relative to the rails 74*a*, 74*b* and in a direction along the rail axis Ra. Accordingly, the position of the back support 122 can be adjusted along the rail axis Ra (or along the rails 74*a*, 74*b*). Once a desired position is reached, the levers 98 are released, allowing the biasing member 118 to bias the pin 102 towards the respective rail 74*a*, 74*b*. Each pin 102 is then positioned into a selected groove 90 in the respective rail 74*a*, 74*b*. The fasteners 114 can then be installed into each aperture 110*a*, 110*b* in the respective slide 78*a*, 78*b* until received in an associated groove 90 in the respective rail 74*a*, 74*b*.

The attachment and adjustment assembly 10 advantageously provides for positional adjustment of the back support 122 while a user is sitting in the powered wheelchair. This allows for proper fitting and/or adjustment of the back support 122 without always necessitating removal of the user from the powered wheelchair. In addition, the attachment and adjustment assembly 10 facilitates mounting of different back supports 122 to different commercially available seat backs of powered wheelchairs without the need to customize each back support 122 to a certain brand, type, and/or manufacturer of the seat back. These and other advantages or features may be set forth by the disclosure or in the claims.

What is claimed is:

1. An attachment and adjustment assembly for a chair comprising:

a planar mounting plate including a first member spaced from a second member, and a third member interconnecting the first and second members, the first, second and third members define an opening through the mounting plate, and at least one mounting aperture extending through the mounting plate and adapted to receive a fastener to removably attach the mounting plate to a seat back of the chair;

a track assembly coupled to the mounting plate and oriented to not overlap the opening; and a back support coupled to the track assembly, wherein the track assembly facilitates vertical sliding movement of the back support relative to the mounting plate.

2. The attachment and adjustment assembly of claim 1, wherein the chair is a wheelchair.

3. The attachment and adjustment assembly of claim 1, wherein the chair is a powered wheelchair.

4. The attachment and adjustment assembly of claim 1, wherein the track assembly includes a rail and a slide that slidably engages the rail.

5. The attachment and adjustment assembly of claim 4, wherein the rail is coupled to the mounting plate and the slide is coupled to the back support.

6. The attachment and adjustment assembly of claim 4, wherein the rail includes a plurality of spaced apart grooves, and the slide includes a pin that is configured to be received by one of the plurality of grooves.

7. The attachment and adjustment assembly of claim 6, wherein the slide includes a lever that is configured to disengage the pin from one of the plurality of grooves.

8. The attachment and adjustment assembly of claim 7, wherein in response to actuation of the lever, the pin is removed from one of the plurality of grooves.

9. The attachment and adjustment assembly of claim 8, wherein a biasing member biases the pin into engagement with one of the plurality of grooves, and in response to actuation of the lever, the lever overcomes the bias of the biasing member.

10. The attachment and adjustment assembly of claim 1, further comprising a mounting member that is coupled to the back support, and further coupled to the track assembly, wherein the track assembly facilitates sliding movement of the back support and the mounting member relative to the mounting plate.

11. The attachment and adjustment assembly of claim 10, the track assembly further comprising:

a first track;

a second track;

a first slide that slidably engages the first track; and a second slide that slidably engages the second track.

12. The attachment and adjustment assembly of claim 11, wherein the first track and the second track are removably attached to the mounting plate.

13. The attachment and adjustment assembly of claim 12, wherein the first slide and the second slide are coupled to the mounting member.

14. The attachment and adjustment assembly of claim 1, wherein the at least one mounting aperture includes a first mounting aperture, a second mounting aperture, and a third mounting aperture, wherein the first mounting aperture is horizontally offset from the second mounting aperture, and the third mounting aperture includes a first edge that is vertically aligned with an edge of the first mounting aperture, and a second edge that is vertically aligned with an edge of the second mounting aperture.

15. The attachment and adjustment assembly of claim 1, wherein the at least one mounting aperture includes a first mounting aperture, a second mounting aperture, and a third mounting aperture, wherein the first mounting aperture is horizontally offset from the second mounting aperture, and the third mounting aperture includes a first slot and a second slot that is orthogonal to the first slot, the first slot is vertically aligned with a slot of the second mounting aperture, and a portion of the second slot is vertically aligned with a slot of the first mounting aperture.

16. The attachment and adjustment assembly of claim 1, wherein the planar mounting plate includes a first side opposite a second side, the planar mounting plate is configured to engage the seat back of the chair in one of a plurality of mounting configurations including:

a first mounting configuration, wherein the track assembly is removably attached to the first side of the planar mounting plate, and the second side of the planar mounting plate faces the seat back; and a second mounting configuration, wherein the track assembly is removably attached to the second side of the planar mounting plate, and the first side of the planar mounting plate faces the seat back.

17. An attachment and adjustment assembly for a chair comprising:

a mounting plate that defines a channel;

a first track removably fastened to the mounting plate and defining a first rail axis;

a first slide positioned in sliding engagement with the first track and configured to slide relative to the first track along the first rail axis;

a second track removably fastened to the mounting plate and defining a second rail axis;

a second slide positioned in sliding engagement with the second track and configured to slide relative to the second track along the second rail axis;

a mounting member coupled to the first slide and the second slide; and a back support coupled to the mounting member, wherein the first track is positioned on a first side of the channel, the second track is positioned on a second side of the channel, the first rail axis being parallel to the second rail axis, and wherein the first slide and the second slide are configured to facilitate sliding movement of the back support relative to the mounting plate.

18. The attachment and adjustment assembly of claim 17, the mounting plate further comprising:

a first mounting aperture;

a second mounting aperture that is horizontally offset from the first mounting aperture; and a third mounting aperture that includes a first edge opposite a second edge, the first edge is vertically aligned with an edge of the first mounting aperture, and the second edge is vertically aligned with an edge of the second mounting aperture.

19. The attachment and adjustment assembly of claim 17, wherein the chair is a powered wheelchair.

20. The attachment and adjustment assembly of claim 17, wherein the mounting plate includes a first side opposite a second side, the mounting plate being configured to engage a seat back of the chair in one of a first mounting configuration and a second mounting configuration, wherein in the first mounting configuration, the first track and the second track are removably fastened to the first side of the mounting plate, and wherein in the second mounting configuration, the first track and the second track are removably fastened to the second side of the mounting plate.

* * * * *